US009167328B2

(12) United States Patent
Blendinger

(10) Patent No.: US 9,167,328 B2
(45) Date of Patent: Oct. 20, 2015

(54) VALVE APPARATUS, HEARING DEVICE WITH THE VALVE APPARATUS, AND METHOD

(71) Applicant: SIVANTOS PTE. LTD., Singapore (SG)

(72) Inventor: Michael Blendinger, Nuremberg (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/193,059

(22) Filed: Feb. 28, 2014

(65) Prior Publication Data

US 2014/0238774 A1 Aug. 28, 2014

(30) Foreign Application Priority Data

Feb. 28, 2013 (DE) ..... 10 2013 203 334

(51) Int. Cl.
*H04R 25/00* (2006.01)
*H04R 1/10* (2006.01)

(52) U.S. Cl.
CPC ..... *H04R 1/1016* (2013.01); *H04R 1/1041* (2013.01); *H04R 25/656* (2013.01); *H04R 1/105* (2013.01); *H04R 2225/025* (2013.01); *H04R 2225/61* (2013.01); *H04R 2225/63* (2013.01); *H04R 2460/11* (2013.01); *H04R 2460/15* (2013.01)

(58) Field of Classification Search
CPC ..... H04R 25/656; H04R 2460/11; H04R 2460/15; H04R 1/1016; H04R 1/1041; H04R 1/105; H04R 2225/025; H04R 2225/61; H04R 2225/63
USPC ..... 181/129, 130, 135
See application file for complete search history.

(56) References Cited

U.S. PATENT DOCUMENTS

| | | | | |
|---|---|---|---|---|
| 3,834,394 | A | 9/1974 | Hunter et al. | |
| 4,834,211 | A | 5/1989 | Bibby et al. | |
| 6,094,494 | A | 7/2000 | Haroldson | |
| 8,548,181 | B2 | 10/2013 | Kraemer | |
| 2009/0293886 | A1 | 12/2009 | Dedrick et al. | |
| 2011/0182453 | A1* | 7/2011 | Van Hal et al. | 381/328 |

FOREIGN PATENT DOCUMENTS

| | | | |
|---|---|---|---|
| WO | 2012007067 | A1 | 1/2012 |
| WO | 2012007193 | A1 | 1/2012 |

* cited by examiner

*Primary Examiner* — Jeremy Luks
(74) *Attorney, Agent, or Firm* — Laurence A. Greenberg; Werner H. Stemer; Ralph E. Locher

(57) ABSTRACT

When volume-changeable elements are used in earpiece apparatus, a valve apparatus for expanding and contracting purposes is provided. A valve apparatus is provided with a discharge opening for the outlet of air from the volume-changeable element. The discharge opening can be closed directly by the volume-changeable element itself.

13 Claims, 4 Drawing Sheets

FIG 3
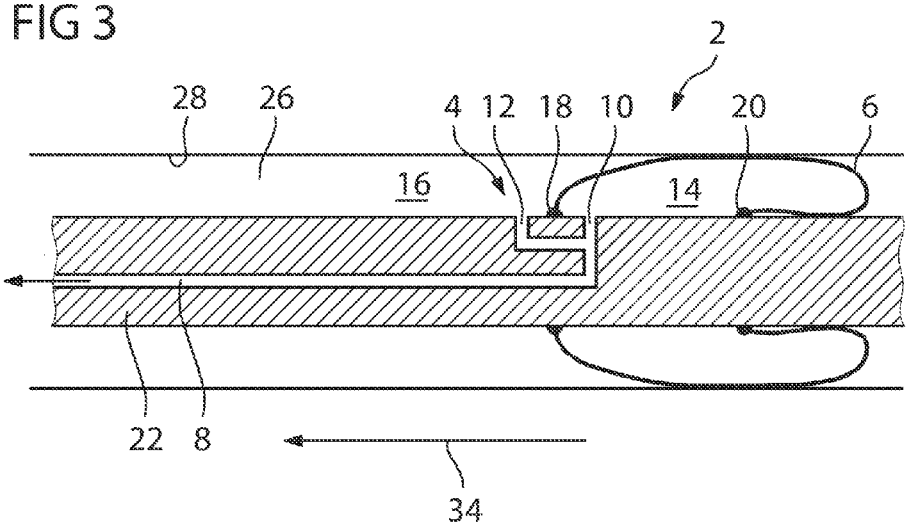
FIG 4A
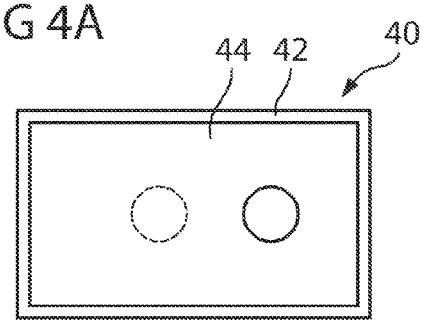
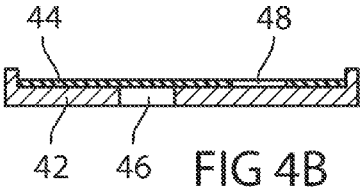
FIG 4B
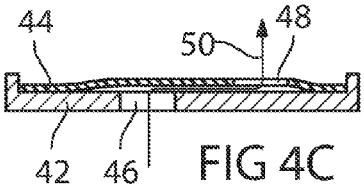
FIG 4C

VALVE APPARATUS, HEARING DEVICE WITH THE VALVE APPARATUS, AND METHOD

CROSS-REFERENCE TO RELATED APPLICATION

This application claims the priority benefit, under 35 U.S.C. §119, of German patent application DE 10 2013 203 334.6, filed Feb. 28, 2013, which application is herewith incorporated by reference in its entirety.

BACKGROUND OF THE INVENTION

Field of the Invention

The invention relates to a valve apparatus for a volume-changeable element of an earpiece. The valve apparatus has a pressure channel for supplying and/or discharging a medium to/from the volume-changeable element. The pressure channel has a supply section, which leads to an inner area of the volume-changeable element, and the pressure channel leads, by way of a discharge opening, to an outer area outside of the earpiece and the volume-changeable element. The invention further relates to a method wherein an earpiece with a volume-changeable element is inserted into an ear canal and a medium is supplied by way of a pressure channel to the volume-changeable element.

The invention is preferably used in hearing device units. A hearing device unit here refers to any sound-emitting device which can be worn in or on the ear or on the head, such as a hearing device, a hearing aid, a headset, headphones and the like.

Hearing devices are wearable hearing apparatuses, which serve to assist people with hearing difficulties. In order to accommodate numerous individual requirements, various types of hearing devices are available such as behind-the-ear (BTE) hearing devices, hearing device with external receiver (RIC: receiver in the canal) and in-the-ear (ITE) hearing devices, for example also concha hearing devices or completely-in-the-canal (ITE, CIC) hearing devices. The hearing devices listed by way of example are worn on the outer ear or in the auditory canal. Also available on the market are bone conduction hearing aids, implantable hearing aids and vibrotactile hearing aids. With these the damaged hearing is stimulated either mechanically or electrically.

The acoustic signal is routed from the loudspeaker or receiver to an earpiece by way of a sound tube. This earpiece is in turn inserted into an ear canal. In an in-ear loudspeaker the loudspeaker is affixed not in the hearing device unit but in the earpiece. Such a loudspeaker is connected directly to the earpiece and is inserted into the auditory canal together therewith.

When an earpiece is used, it is important that the same is held firmly in the ear canal of the user. There are various approaches for this. One is to make the earpiece available with a volume-changeable element similar to an inflatable balloon. After inserting the earpiece into the ear canal, the volume-changeable element located therein is inflated such that it adapts to the ear canal. A secure fit in the ear canal is thus ensured.

For a user-friendly removal of an earpiece of this type from the ear canal, the air must be removed again from the volume-changeable element. One problem here is that a complicated pump apparatus must be provided for inflating and deflating the volume-changeable element.

SUMMARY OF THE INVENTION

It is accordingly an object of the invention to provide a valve apparatus a hearing device with the valve apparatus and a corresponding method which overcome a variety of disadvantages of the heretofore-known devices and methods of this general type and which provides for a simplified valve apparatus for inflating and deflating the volume changeable element.

With the foregoing and other objects in view there is provided, in accordance with the invention, a valve apparatus for a volume-changeable element of an earpiece. The valve apparatus comprises:

a pressure channel for supplying a medium to and discharging the medium from the volume-changeable element;

said pressure channel having a supply section leading to an interior of the volume-changeable element;

said pressure channel leading, by way of a discharge opening, to an exterior outside the earpiece and the volume-changeable element; and said discharge opening and the volume-changeable element being disposed relative to one another to enable the volume-changeable element to selectively close said discharge opening.

In other words, the above object is achieved by a valve apparatus for a volume-changeable element on an earpiece apparatus, having a pressure channel for supplying or discharging a medium, preferably air, to/from the volume-changeable element. The pressure channel has a supply segment, which leads to an interior of the volume-changeable element by way of a supply opening. Furthermore, the pressure channel leads to an outer area outside of the earpiece and the volume-changeable element by means of a discharge opening. The discharge opening can be closed by means of the volume-changeable element. This closing process is effected by pumping up the volume-changeable element. As a result, it expands and gradually closes the discharge opening in the process.

The discharge opening is preferably arranged directly adjacent to a fastening point or bonding point of the volume-changeable element on the earpiece apparatus. As a result, the volume-changeable element can more easily close the discharge opening if it is inflated in an ear canal. During the pumping process, the volume-changeable element expands in all directions and during this process it can close the discharge opening on account of its expansion.

This allows for a simplified construction of the earpiece apparatus. The volume-changeable element is also used for a secure fit in an ear canal as a sealing means for its own outlet. The usually flexible material, e.g. a rubber or plastic material, from which the volume-changeable elements are produced, already brings with it good sealing properties.

In a development, the discharge opening can be closed by the volume-changeable element such that the medium cannot pass through the discharge opening. The closure of the discharge opening by means of the volume-changeable element is preferably to be air-tight. An inflated state of the volume-changeable element can thus be kept stable for longer.

In a further embodiment, a section of a fastening point of the volume-changeable element is arranged such that the volume-changeable element which is inflated in an ear canal closes the discharge opening with part of its wall. When the volume-changeable element is pumped up within an ear canal, the expansion direction of this elastic part is delimited by the width of the ear canal. The volume-changeable element will thus extend further laterally in the ear canal. The discharge opening is preferably directly adjacent to a fastening point of the volume-changeable element. During lateral extension, the volume-changeable element will therefore extend across the discharge opening located directly adjacent to its fastening point and close this in an air-tight manner with a corresponding structural design.

In a further embodiment, a cover region on the volume-changeable element corresponds in a partially form-fit fashion with the discharge opening, so that this cover region assists with the closing of the discharge opening. The discharge opening may for instance be embodied in the manner of a cone or funnel. As a counterpart, a conical plug area could be arranged on the wall of the volume-changeable element. The approximately form-fit design improves the seal of the discharge opening.

In a further embodiment, an emergency opening apparatus is embodied on the discharge opening, which blocks the closing possibility of the discharge opening from the volume-changeable element. A pin or a switch is preferably arranged on the earpiece such that with a manual actuation, this lifts the volume-changeable element closing the discharge opening so that air from the volume-changeable element can escape through the discharge opening.

In a further embodiment, the discharge opening is covered by an auxiliary sealing apparatus. The auxiliary sealing apparatus is for instance a rubber flap or a cover made of an otherwise flexible material, which is able to ensure an at least minimal air tightness in the discharge opening. This flap is to be attached across the discharge open and is to cover the same. If a specific hydrostatic pressure of the medium located therein is achieved from the direction of the discharge section, this flap opens on account of the pressure prevailing thereupon. The auxiliary sealing apparatus has a function as a valve.

A further situation may be that a volume-changeable element which can be inflated in the ear canal lies across the auxiliary sealing apparatus. The auxiliary sealing apparatus is covered by the volume-changeable element, which keeps this sealed to a greater degree by additional pressure. A pressure from the discharge section of the pressure channel must then be higher than if the volume-changeable element does not lie on the auxiliary sealing apparatus, in order to press the same.

In a further embodiment, the auxiliary sealing apparatus is a membrane valve arrangement. This type of design is a special valve, which is explained in the description of the figures.

In a development, the auxiliary sealing apparatus is embodied such that the discharge opening closed by the volume-changeable element is to be opened mechanically or electrically. The auxiliary sealing apparatus can be realized on the one hand as a simple pin or lever, which lifts the volume-changeable element away from the discharge opening. On the other hand, it can also be realized electrically. For instance, with so-called electroactive polymers. Electroactive polymers change their shape when a voltage is applied. In this instance they could be designed such that they are arranged below a flap and they extend, when a voltage is applied, so that they put pressure on the flap.

In a further embodiment, a one-way valve is arranged in the pressure channel, said one-way valve only allowing the medium to pass in one through-direction of the one-way valve. The positioning of a one-way valve in the pressure channel prevents the medium from flowing back into a pump, from which it is pumped into the volume-changeable element. Since an inflated volume-changeable element is under pressure, this pressure must be maintained. This can be achieved by means of a sustained pumping process or by preventing the backflow of the pumping medium through the one-way valve.

With the above and other objects in view there is also provided, in accordance with the invention, a novel method of placing an ear piece into an ear canal. The method comprises the following steps:

inserting an earpiece apparatus with a volume-changeable element into the ear canal;

supplying an inflation medium by way of a pressure channel of the earpiece apparatus to the volume-changeable element; and inflating the volume-changeable element by supplying the medium and thereby causing the volume-changeable element to close a discharge opening communicating with an interior of the volume-changeable element and the pressure channel with regard to an exterior ambient of the earpiece apparatus.

In other words, the objects cited at the start are further achieved by a method which includes inserting an earpiece apparatus with a volume-changeable element into an ear canal, supplying a medium by means of a pressure channel on the earpiece apparatus to the volume-changeable element, so that by way of the supply of medium, the volume-changeable element is inflated such that it seals a discharge opening of the pressure channel with respect to the outer area outside of the earpiece apparatus.

In a further embodiment of the method, the volume-changeable element will release the discharge opening when removing the earpiece apparatus from the ear canal.

In a further embodiment of the method, when removing the earpiece apparatus from the ear canal, the friction of the volume-changeable element on the ear canal contributes to the discharge opening being released. During the removal process, part of the volume-changeable element will remain stuck to the ear canal by means of friction. The subarea of the volume-changeable element, which covers the discharge opening, lifts as a result herefrom and releases the same. Air flows from inside the volume-changeable element through the discharge section to outside of the earpiece apparatus. The volume-changeable element sags and the earpiece apparatus can thus be removed more easily from the ear canal.

In an advantageous development of the method, a pump pumps the medium through the pressure channel into the volume-changeable element. The pump can be a so-called receiver usually used as a loudspeaker in hearing devices.

The description herein refers to air as the inflation medium. The term air, however, should be understood as representing a synonym for all fluids, gases or any other such medium that is suitable for the purpose.

Other features which are considered as characteristic for the invention are set forth in the appended claims.

Although the invention is illustrated and described herein as embodied in valve apparatus and a hearing device, it is nevertheless not intended to be limited to the details shown, since various modifications and structural changes may be made therein without departing from the spirit of the invention and within the scope and range of equivalents of the claims. Specifically, the various embodiments that are specifically described below to not represent a definitive limitation to the embodiments described. Further different embodiments are possible.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 2 and 3 are diagrammatic views of the earpiece from FIG. 1 upon insertion and removal from an ear canal;

FIG. 4A is a plan view onto an embodiment of a membrane valve;

FIGS. 4B and 4C are side views of the membrane valve at mutually different operational positions;

DETAILED DESCRIPTION OF THE INVENTION

Figure 1:
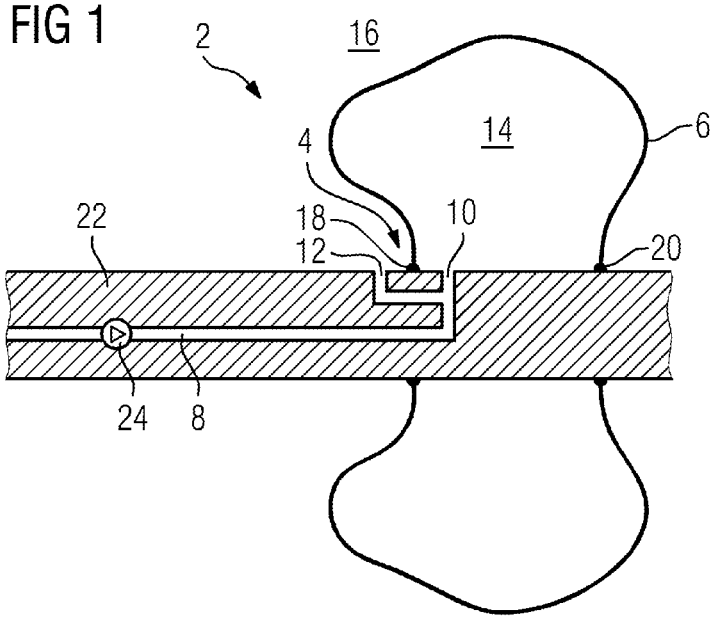
FIG. 1 is a sketch of an earpiece with a valve apparatus according to the invention.

Referring now to the figures of the drawing in detail and first, particularly, to FIG. 1 thereof, there is shown an earpiece 2 of a hearing aid, which is a representative embodiment of the novel hearing device. The earpiece 2 has a valve apparatus 4. It also shows a pressure channel 8 with a one-way valve 24 and a Y-branch, which flows once through a supply section 10 into the inner area 14 of a volume-changeable element 6, while the other branch leads through a discharge opening 12 to an exterior 16, or ambient area, outside of the earpiece apparatus 2 and the volume-changeable element 6.

In this embodiment, the volume-changeable element 6 is preferably arranged with an inner bonding point 20 and an outer bonding point 18 on a housing apparatus 22 of the earpiece apparatus 2. The inner bonding point 20 is that which is inserted into an ear canal upstream of the outer bonding point 18 upon insertion of the earpiece apparatus. In other words, that which is further inside the ear than the outer bonding point 18 after insertion into an ear canal. The term bonding or bonding point is used here as a synonym for all types of fastening of a volume-changeable element on the earpiece apparatus. Fastening types can inter alia be glue, plug-in connectors, reverse-drawing or other types of fastening. In this exemplary embodiment the bonding points are circumferential around the housing apparatus 22. The volume-changeable element 6 in this embodiment is further preferably manufactured from an elastic material. When an overpressure or underpressure is applied, it can extend and also contract.

Air is pumped through the pressure channel 8 in the direction of the volume-changeable element 6. This air firstly flows back both through the supply section 10 and also through the discharge opening 12. The air reaches the outer area 16 and the inner area 14 proportionately. The proportion of air which flows through the supply section 10 into the inner area 14 of the volume-changeable element gradually fills this until it begins to extend on account of its elasticity. The volume-changeable element 6 is constructively fastened to the outer bonding point 18 such that it extends here with increasing expansion across the discharge opening 12 so that this is covered in an almost air-tight manner. Once this has taken place, air can no longer pass through the discharge opening 12 to the outer area 16. All the air pumped through the pressure channel 8 is thus guided into the inner area 14.

For instance, pressure sensors (not shown) can determine whether sufficient air or sufficient pressure is located in the volume-changeable element 6. The pumping of air is then adjusted. A backflow of air from the inner area 14 opposite to the pump direction can be prevented in the pressure channel 8 by the check valve or one-way valve 24.

When the earpiece apparatus 2 is used in a hearing device, air can be pumped for instance by means of a receiver, in other words the loudspeaker of the hearing device. The receiver can be arranged here both directly on the earpiece apparatus or in the hearing device itself.

Figure 2:
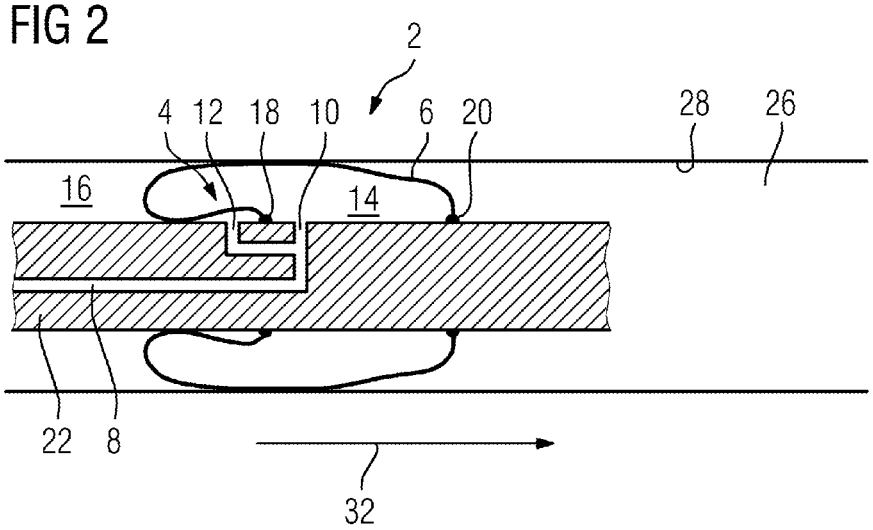

The embodiment of the earpiece apparatus 2 from FIG. 1 is shown in FIG. 2 upon insertion and in FIG. 3 upon removal from an auditory canal 26.

FIG. 2 shows the insertion of the earpiece apparatus 2 into an ear canal 26. To this end, the earpiece apparatus 2 is moved in the direction of the arrow 32, which symbolizes an insertion direction. The elastic, non-inflated volume-changeable element 6 rubs against the inner wall 28 of the ear canal 26 during insertion. As a result, the volume-changeable element 6 rests, as shown, on the earpiece apparatus 2.

Depending on the dimensioning of the volume-changeable element 6, it extends, as in this exemplary embodiment, already upon insertion into the ear canal across the discharge opening 12. When the volume-changeable element 6 is inflated, the discharge opening 12 would be covered in an air-tight manner from the outset. All the pumping air is thus similarly available to the inner area 14 of the volume-changeable element 6.

In another embodiment (not shown), the volume-changeable element 6 does not extend across the discharge opening upon insertion, but only after pumping into the ear canal 26.

In both the instances just mentioned, an inflated volume-changeable element 6 covers the discharge opening 12. In this way, no air can escape from the inner area 14 through the discharge opening 12 to the outer area 16. It is naturally possible for an insignificantly small amount of air to pass through the discharge opening 12 on account of constructive measuring tolerances or suchlike. The air-tightness of the covered discharge opening 12 can be improved accordingly by means of a suitable material selection for the volume-changeable element 6, for instance plastic or rubber.

FIG. 3 shows the removal of the earpiece apparatus 2 from an ear canal 26. To this end, the earpiece apparatus 2 is moved in the direction of the arrow 34, which symbolizes a removal direction. Upon removal, part of the outer surface of the volume-changeable element 6 adheres to the inner wall 28 of the ear canal 26. This results in the housing apparatus 22 being moved out of the ear canal 26 more quickly or sooner relative to the volume-changeable element 6. In other words, the volume-changeable element 6 inverts here such that it rests against an opposite region of the housing apparatus 22 to that upon which it was placed during insertion and wear.

A side effect of this is that the discharge opening 12 covered previously by the volume-changeable element 6 is now released. Air can thus flow unhindered from the inner area 14 through the discharge opening 12 to the outer area 16. The pressure in the inner area 14 builds up, which allows the elastic volume-changeable element 14 to collapse. This in turn results in the entire earpiece apparatus 2 being more easily removable from the ear canal 26 since the friction on the inner wall 26 is negligible.

FIG. 4, with its three views FIG. 4A, 4B, 4C shows a conventional membrane valve 40. The valve has a valve body 42 with a valve body opening 46 and a membrane 44 with a membrane opening 48. The valve body 42 and the membrane 44 are arranged such that their respective openings 46 and 48 do not intersect. The membrane valve 40 is preferably a one-way valve, which only has one through-direction.

The membrane valve is shown in a top view in FIG. 4A and it is shown in a side view in FIGS. 4B and 4C. Its mode of operation is shown at bottom right in a side view. Arrow 50 symbolizes an air flow through the membrane valve 40. As soon as a specific pressure is applied to the membrane 44 by the valve body opening 46, this is lifted and air can flow through the membrane valve 40, as shown, by means of the two openings 46 and 48.

Figure 5:
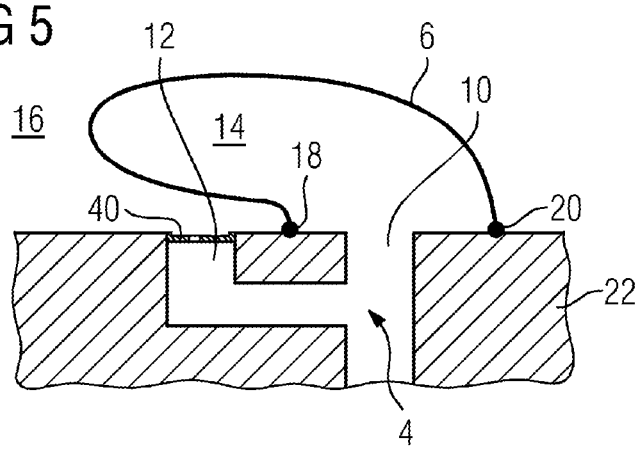
FIG. 5 is a diagram of an implementation of the membrane valve according to FIG. 4 in a valve apparatus.

FIG. 5 shows an embodiment of a valve apparatus 4 on an earpiece apparatus 2, which has a membrane valve 40, as shown in FIG. 4, arranged on the discharge opening 12. The mode of operation of this embodiment is similar to that already described above. If the volume-changeable element 6 does not extend across the discharge opening and thus not across the membrane valve 40, then only the pressure for lifting the membrane 44 has to be overcome in order to open the membrane valve 40. If the volume-changeable element 6 is pumped and extends, as described above, across the discharge opening 12 with the membrane valve, then this cannot open.

The advantage of attaching a valve such as the membrane valve 40 to the discharge opening 12 lies in pumping air firstly reaching the direction of the discharge opening 12 when a contracted, relaxed volume-changeable element 6 is initially inflated. Pumping air would then be lost in the outer area 16 until the inner area 14 of the volume-changeable element 6 is sufficiently inflated, in order to be able to close the discharge opening 12. Additional closing pressure is thus applied to the membrane valve 40 with the volume-changeable element 6. This can then only be opened with significantly more pressure than beforehand. The arrangement of a membrane valve 40 can reduce the unwanted pressure air outflow when pumping out to the outer area 16. Which pressure is required to open the membrane valve 40 is dependent in particular on its constructive design and choice of material.

Figure 6:
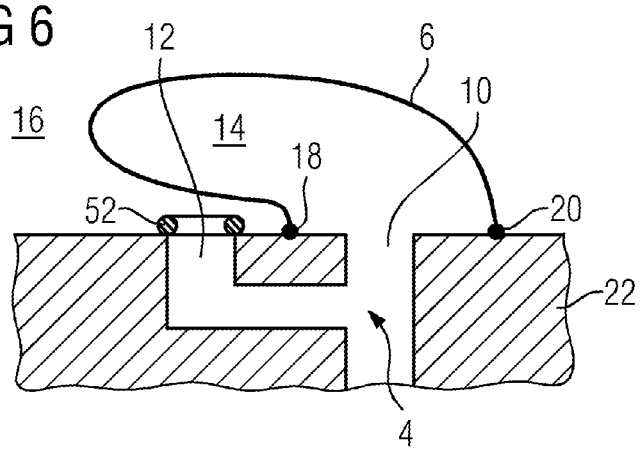
FIGS. 6-10 show diagrammatic illustrations of various embodiments and possibilities of the seal of a valve apparatus.

FIG. 6 shows a further embodiment, in which an auxiliary sealing apparatus 52 is arranged on the discharge opening 12. This auxiliary sealing apparatus 52 can consist of one or a number of individual parts. It is preferably a sealing ring configured in a circular fashion which runs around the discharge opening 12. For instance, a so-called O-ring. An effectively sealing material such as rubber or plastic is preferably used as the material. The auxiliary sealing apparatus 52 is fastened in this embodiment on the edges of the discharge opening 12. Adhesive can be selected for instance as the type of fastening. The use of an auxiliary sealing apparatus 52 improves the air sealing property if the volume-changeable element 6 extends, as described above, across the discharge opening 12 and thus across the auxiliary sealing apparatus 52 and covers the same.

Figure 7:
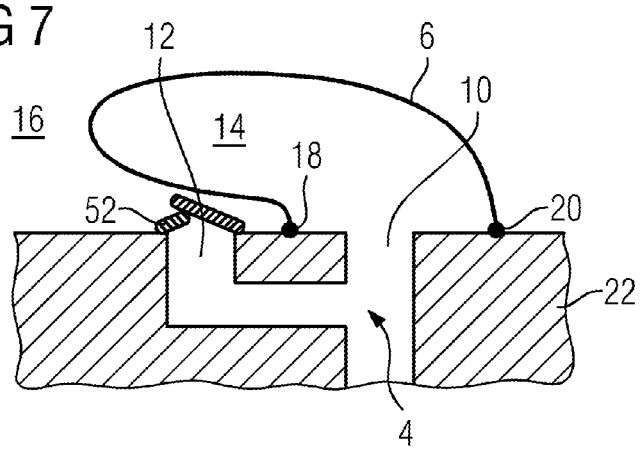

Other realizations of the auxiliary sealing apparatus 52 are also possible. This may involve for instance two elastically overlapping rubber plates. This is shown in FIG. 7.

Figure 8:
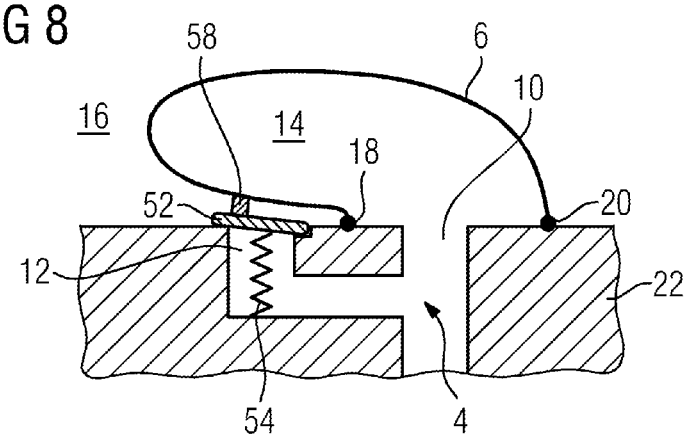

FIG. 8 illustrates a further embodiment. An auxiliary sealing apparatus 52 in the form of a rubber or plastic plate is fastened here on a subarea in the vicinity of the edge of the discharge opening 12. It is attached such that it can cover the discharge opening 12 in a flexible and elastic manner. It is kept in an idle state with a pull spring element 54, such that it keeps the discharge opening 12 closed using little force compared with the air pressure of the inner area 14.

An opening aid 58 also ensures that the volume-changeable element 6 and the auxiliary sealing apparatus 52 are physically connected. This connection may be elastic or rigid. The opening aid 58 can be an adhesive point for instance between the volume-changeable element 6 and the auxiliary sealing apparatus 52. The advantageous effect is that when removing the earpiece apparatus 2 from an ear canal, the volume-changeable element 6 turns away from the discharge opening 12. On account of the opening aid 58, the auxiliary sealing apparatus 52 pulls upwards. The air can thus flow through the discharge opening 12. Once the earpiece apparatus 2 has been removed from the ear canal, but also upon insertion into the ear canal, the pull spring element 54 keeps the discharge opening 12 closed.

Figure 9:
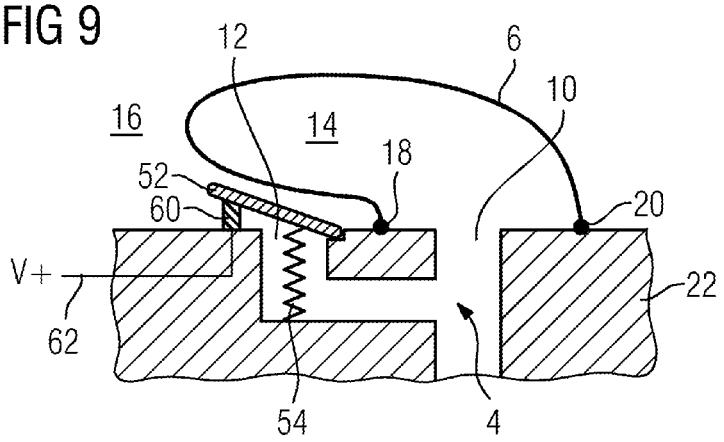

The embodiment in FIG. 9 is similar to the preceding embodiment, except that the volume-changeable element 6 is not in contact with the auxiliary sealing apparatus 52 by means of an opening aid 58. The opening of the auxiliary sealing apparatus 52 takes place here by means of an opening mechanism 60, which in this embodiment are so-called electroactive polymers. Electroactive polymers can be designed such that they enlarge or extend when a voltage 62 is applied. Conversely, they contract again when the voltage 62 is switched off. The auxiliary sealing apparatus can be opened and closed again as shown by way of example in the Figure. A pull spring element 54 can also be attached so as to assist with the closing process.

Figure 10:
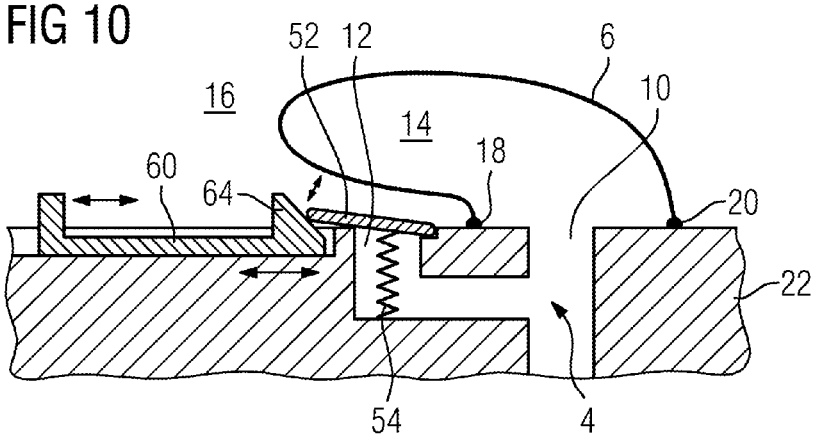

Also in the embodiment in FIG. 10, the discharge opening 12 is held closed again by means of a auxiliary sealing apparatus 52 and a pull spring element 54. Nevertheless, the opening mechanism 60 is designed here as a manual sliding lever. This can be moved laterally, as shown. This has a ramp 64 at one end, on which the unfastened end of the auxiliary sealing apparatus 52 rests. When moving the sliding lever laterally, the auxiliary sealing apparatus 52 is thus lifted by means of the ramp 64 and air can pass through the discharge opening 12.

The invention claimed is:

1. An earpiece, comprising:

an inflatable, volume-changeable element disposed at a housing apparatus;

a valve apparatus formed with a pressure channel for supplying a medium to and discharging the medium from said volume-changeable element;

said pressure channel having a supply section leading to an interior of said volume-changeable element and said pressure channel leading, by way of a discharge opening, to an exterior outside said volume-changeable element; and said volume-changable element having an inner bonding point and an outer bonding point, which is mounted to said housing apparatus and disposed behind the inner bonding point in an insertion direction of said housing apparatus into an ear canal;

said supply section being disposed between said inner and outer binding points and said discharge opening being disposed in front of said outer bonding point in the insertion direction, so that said volume-changeable element, which is inflated inside the ear canal, closes the discharge opening with part of a wall of said volume-changable element.

2. The earpiece according to claim 1, wherein a cover region on the volume-changeable element corresponds in a partially form-fit manner with said discharge opening.

3. The earpiece according to claim 1, which comprises an opening mechanism disposed on said discharge opening and configured to block a closure of said discharge opening by the volume-changeable element.

4. The earpiece according to claim 1, which comprises an auxiliary sealing apparatus covering said discharge opening.

5. The earpiece according to claim 4, wherein said auxiliary sealing apparatus is a membrane valve.

6. The earpiece according to claim 4, wherein said auxiliary sealing apparatus is configured to mechanically or electrically open said discharge opening that is closed off by the volume-changeable element.

7. The earpiece according to claim 1, which comprises a one-way valve disposed in said pressure channel and configured to allow the medium to pass in one through-direction.

8. The earpiece according to claim 1, wherein the medium is air.

9. A hearing device, comprising an earpiece according to claim 1.

10. A method of inflating and deflating an ear piece in an ear canal, the method comprising:

providing an earpiece according to claim 1;

inserting the earpiece with the volume-changeable element into the ear canal;

supplying an inflation medium by way of the pressure channel to the volume-changeable element, for inflating the volume-changeable element and thereby causing the volume-changeable element to close a discharge opening communicating with an interior of the volume-changeable element and the pressure channel with regard to an exterior ambient of the earpiece.

11. The method according to claim 10, which comprises subsequently removing the earpiece apparatus from the ear canal and thereby causing the volume-changeable element to release the discharge opening.

12. The method according to claim 11, wherein, upon removing the earpiece apparatus from the ear canal, causing a friction between the volume-changeable element and a wall of the ear canal to contribute to releasing the discharge opening.

13. The method according to claim 10, wherein the inflating step comprises pumping the medium through the pressure channel with a pump to thereby inflate the volume-changeable element.

* * * * *